United States Patent [19]

Hilemn

[11] 4,077,517

[45] Mar. 7, 1978

[54] FURNITURE KIT

[76] Inventor: Charles Hilemn, 21 E. Rocket Cir., Park Forest, Ill. 60466

[21] Appl. No.: 777,135

[22] Filed: Mar. 14, 1977

[51] Int. Cl.[2] ..... B65D 85/00; B65D 85/54; A47C 7/00

[52] U.S. Cl. ..... 206/577; 297/440

[58] Field of Search ..... 206/577; 297/440, 441

[56] References Cited

U.S. PATENT DOCUMENTS 3,929,375 12/1975 Gans ..... 297/440

3,973,800 8/1976 Kogan ..... 297/440

*Primary Examiner*—George T. Hall

[57] ABSTRACT

The disclosure is directed to a prefabricated kit for the manufacture of furniture and includes a series of support panels having indexing marks to locate foam cushioning, adhesive means to fasten said cushioning, and indexing marks to locate upholstery fabric to be fastened to said panels, all of said panels bearing identifying symbols to assist in mutual assembly into the configuration of a furniture piece.

4 Claims, 6 Drawing Figures fig.3.
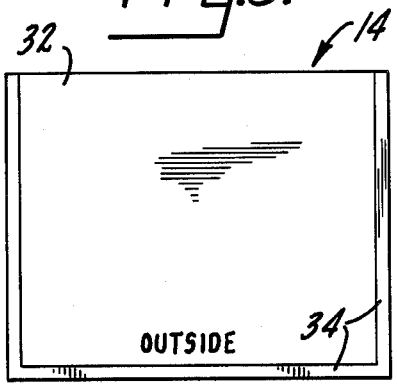
fig.4.
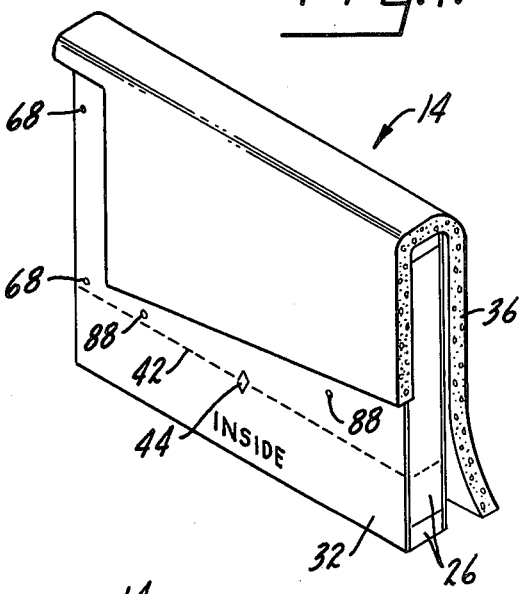
fig.5.
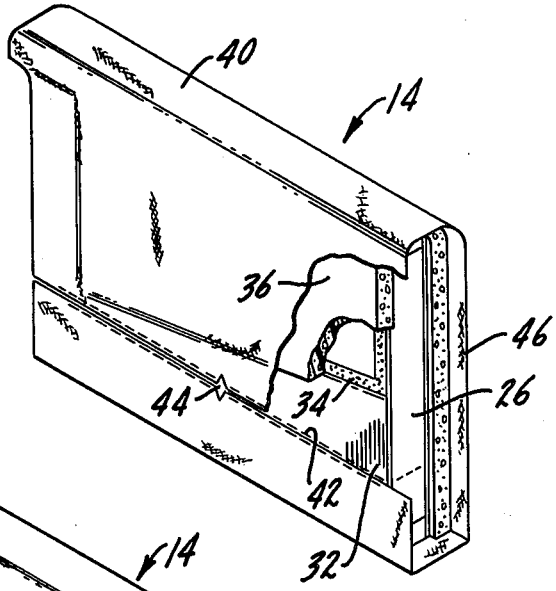
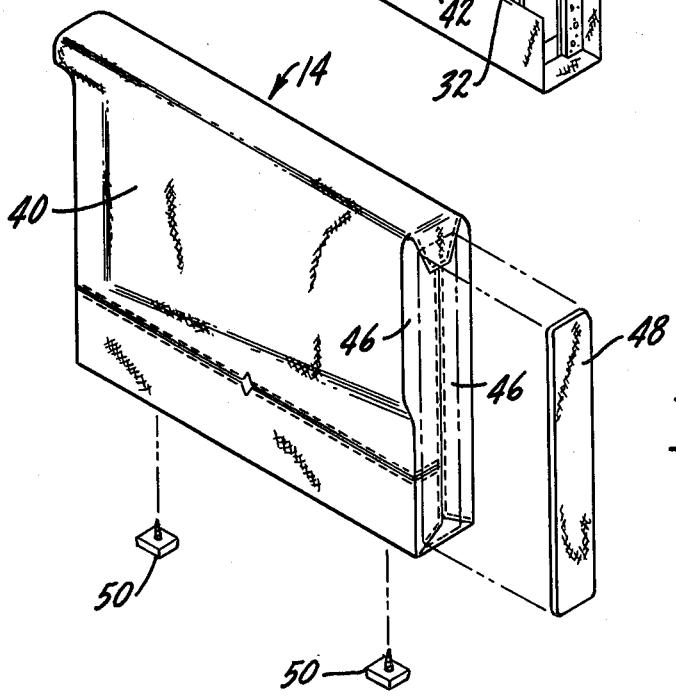
fig.6.

FURNITURE KIT

BACKGROUND OF THE INVENTION

1. Field of the Invention

The invention relates generally to furniture which is assembled by the consumer-purchaser, and, more particularly, to upholstered furniture whose cushioning and upholstery are applied by the consumer in the assembly process.

2. Description of the Prior Art

In the past, upholstered furniture has been typically assembled at a factory, and shipped to a retailer who sells the furniture to the ultimate consumer. This procedure has resulted in high cost due to factory labor and due to the transportation costs inherent in moving and storing bulky articles such as furniture pieces. Also, if the retailer is to be competitive in meeting the demands of consumers who require a large selection of colors and patterns of upholstery, the inventory required to be maintained by him can be undesirably large.

SUMMARY OF THE INVENTION

Applicant's invention provides an upholstered chair which is sold in component pieces to be assembled by the consumer. In this manner, an otherwise large piece of furniture can be conveyed to the retailer and consumer in a compact form which is easy to store and move. Further, the style of upholstery fabric may be independently chosen by the consumer so that diversity of selection of colors and patterns is not limited by the number of chairs which a retailer may have in stock at a given time. Still further, applicant's invention allows any retailer who wish to do so to assemble the chairs themselves, allowing a merchant to supply consumer demand by showroom display without the need for a massive inventory to fill orders of the consumers.

These results are obtained by utilizing preformed panels which are easily packaged and which may be subsequently joined to each other by bolts, the panels being of exact dimension to form the desired furniture piece when laminated with foam and fabric. The panels themselves are composed of rectangular wooden frames covered with sheets of material such as corrugated or fiberboard, and possibly reinforced with plywood sheeting.

The sheet material of the panels bear index symbols for locating the cushioning foam and also affixing means to hold the foam during the intermediate assembly phase which precedes the final stapling of the foam into place, thus eliminating the need for careful manipulation of the foam prior to final stapling.

The sheet material of the panels also bear index symbols for locating and centering the upholstery fabric in a manner which facilitates the stapling of the fabric as well as providing for the concealment of the fabric seams from view in the finished article.

To facilitate assembly in the shape of the chair, the panels are provided with holes for connecting bolts. In addition, the panels bear identification or alignment symbols to designate the function of each, as well as to indicate the points of attachment of each panel to its mate, so that the consumer-finisher can easily visualize the finished base frame and assemble its component panels without mistake. More importantly to indexing, positioning and affixing means together with the specific shape of the foam cushioning and the panels provide the customer with error free assembly of the furniture which results in most desirable appearance.

The functioning and construction of Applicant's invention is more fully explained by the following Detailed Description of the Invention and Description of the Drawings, both of which are presented for puposes of explanation.

DESCRIPTION OF THE DRAWINGS

FIG. 3 is a side elevation view of the outer portion of either the right or left-arm panel.

FIG. 4 is a perspective view with portions cut away, of an arm showing foam positioning.

FIG. 5 is a perspective view with portions cut away, of one of the arm panels showing lamination of the foam and fabric.

FIG. 6 is a perspective exploded view of one of the arm panels showing a closure seam, trim panel and chair feet.

DETAILED DESCRIPTION

Figure 1:
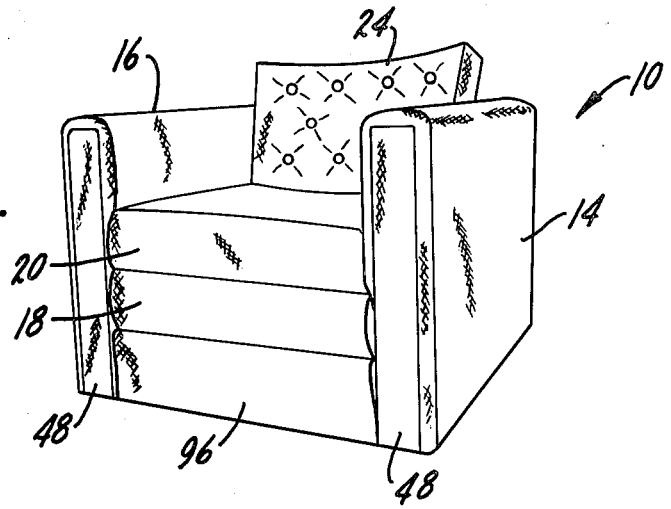
FIG. 1 is a perspective view of the finished form of the preferred embodiment of the invention.

In a preferred embodiment, the furniture kit of my invention is used to form a chair 10 such as that depicted in FIG. 1. Having a conventional appearance, this chair 10 includes two side upstanding side or arm panels 14 and 16 and a seat panel 18 which carries cushion 20. Not shown in this Figure is a back panel 22 (See FIG. 2), which is hidden by a cushion 24.

Figure 2:
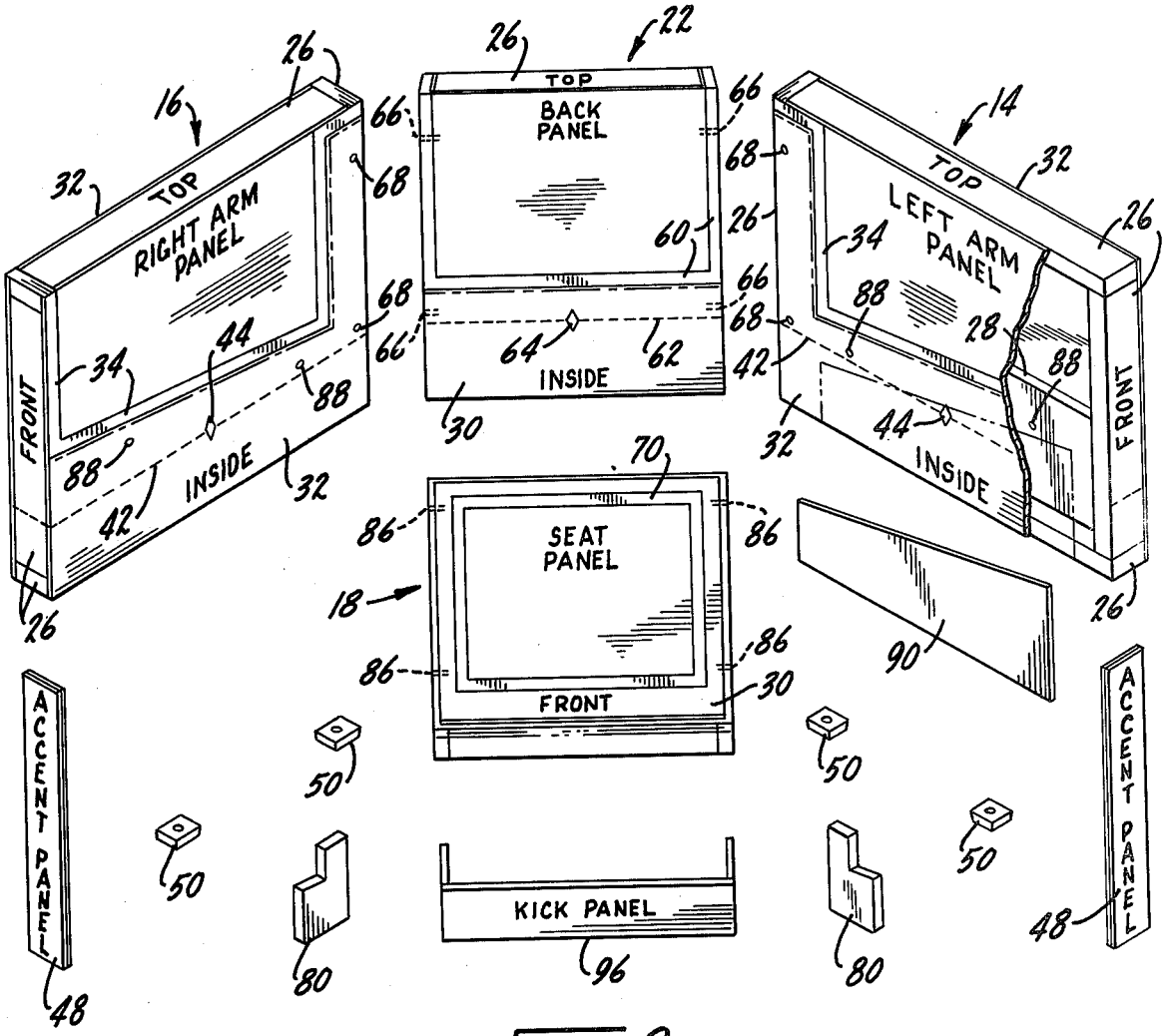
FIG. 2 is an exploded view of the panel skeleton and other components, but without foam or upholstery, with portions broken away to show internal structure.

This attractive chair 10 is a result of assembly of my invention which includes frames for each of the panels shipped to a customer in a compact package by stacking them one upon another. The panels of this package are depicted in FIG. 2. Basically, each panel is formed of four wood members 26 joined together to define a rectangular frame. The top and front of each is appropriately labeled. To provide strength and rigidity to these arm panels 14 and 16, each is provided with a generally horizontal reinforcing member 28. These members 28 also support the seat panel 18 as will be subsequently described.

The seat and back panels 18 and 22 are similar. However, each may be covered with a sheet of plywood 30 to provide a strong supporting surface. As thus described, these four panels provide a rigid frame skeleton for a chair.

That frame, however, is insufficient to provide assurance of an error free assembled chair. To accomplish this purpose, my invention includes instruction, positioning, and affixing means. Such preferably includes cover panels 32 formed of fiberboard or the like and affixed to the side arm panel frames 14 and 16. On the seat and back panels, the instruction and positioning means may be placed directly on the plywood sheets 30.

These means first include a strip of double backed adhesive tape. On the side arm panels this tape is applied as at 34 along a first generally horizontal direction or slightly declining line which corresponds generally to the top of the seat panel 18 which is later assembled. The strip 34 then extends upwardly parallel to the position of the back panel and is then affixed down the front and rear edges of the outer side of the arm panel as shown in FIG. 3. This tape strip 34 is utilized to initially position and hold a precut foam cushioning sheet 36

(See FIG. 4). The lower edge of the foam is initially positioned along the horizontal strip 34, and when positioned, the double backing of the tape is removed to affix its lower edge. From this lower edge, the foam is then extended up and over the top of the arm panel 14 and draped over the outer side of panel 14. The remainder of the double backing of the tape is then removed to position the entire foam sheet 36. It may then be permanently stapled in place by a staple gun. Preferably , these foam sheets 36 have a width greater than that of the arm panels 14 and 16 so as to provide cushioning for the front of the frame formed in a manner subsequently described.

Following foam fixation, the fabric covering 40 may be attached. This fabric is preferably precut and supplied with the kit. Alternatively, a paper pattern (not shown) may be supplied with the kit for separate purchase and cutting of the fabric covering. One end of that covering is provided with a notch. During assembly, that end is placed in alignment with an index line 42 such that the notch is in juxtaposition with a diamond shaped index mark 44. Such will insure a proper extension 46 of the fabric beyond the ends of the frame 14. Along line 42, the covering is then stapled and extended about arm panel 14 until the free end also reaches index line 42 where it is also stapled.

The extensions 46 of the fabric 40 beyond the end of the arm panels are then folded as shown in FIG. 6, for receiving a wooden or fabric covered accent panel 48 which may be nailed or affixed thereto in any conventional manner. This folding also bends the foam extension about the front of the panel. The last step in preparing the arm panels 14 and 16 is the affixation of two small preferably truncated legs 50. Using the indexing and position means of my invention, these components of each arm panel 14 and 16 can be easily and accurately assembled by the unskilled. It should be noted that the reinforcement members 28 are uniquely positioned to not only support the seat in a manner subsequently described, but they also permit stapling and fixation of the foam and fabric at a hidden position on the finished chair.

The back panel 22 also provided with indicia is similar to the side arm panels. It has a double back tape strip 60 which is horizontally applied to the plywood sheet 30 just above its joinder with the seat panel. This strip then extends vertically along edges of the panel on both sides for preliminary positioning of the foam material. Below the bottom of the foam is another index line 62 for the fabric with a similar diamond shaped notch 64 for centering the fabric. Both foam and fabric are affixed by the consumer in a manner similar to assembly of the arm panels 14 and 16.

However, before the fabric is affixed to the rear side of back panel 22, the back panel is first joined to the side panels. The unattached fabric on the rear of back panel 22 permits the insertion of bolts through apertures 66, in the wooden side members 26 and into apertures 68 of the side panels. Subsequently, the fabric covering on the rear side of the back panel is affixed.

The preformed seat panel 18 also carries a tape strip 70 to facilitate positioning of a first foam pad. As shown, such may be rectangular. In addition, a second foam pad may be added and draped over the front of this panel to provide a cushioned appearance. Then a fabric covering is added as with the other panels.

To facilitate joinder of the seat to the side and back panels, L-shaped positioning blocks 80 are provided with the kit. These blocks are nailed to each of the rear bottom corners of the side arm panels such that the L-shaped notch faces the front of the chair. These notches receive and support the rear edge of seat panel 18. Bolts are then passed through apertures 86 of the seat panel frame into the apertures 88 of the reinforcing members 28. Since these latter apertures are covered with fabric, a fiberboard template 90 may be used to locate them. Its outside edges are placed flush with the edges of each arm panel and a sharp instrument is passed through apertures 86, 88 and the fabric covering 40 to separate the fabric. After location and insertion and tightening of the bolts through these, the chair is essentially completed. A U-shaped kick panel 96 can be covered and inserted between side arm panels 14 and 16. Two cushions 20 and 24 may include precut foam covered with fabric in a conventional manner and placed upon the frame as shown.

This preferred emobdiment of my invention thus includes frame panels which have a construction facilitating their assembly by the user. The indicia, positioning and affixing means insures a desirable end product by the user. While depicted in the form of chair, this invention may, with mere dimensional changes and minor support modifications, take the form of a love seat or sofa. The kit may include both precut foam and fabric or paper patterns for their cutting by the customer. If included in the kit, the final package will remain far more compact than a finished chair.

I claim:

1. A furniture kit comprising components for the assembly of an upholstered furniture piece, said kit including:

a. Four rectangular frame members;

b. Two of said frames defining side arm panels of a chair each having horizontal reinforcing member for affixation of a foam cushion and fabric material thereto, said member also being adapted for fixation of a third panel between said first two panels to define a seat;

c. Said fourth frame member being adapted for affixation to said side arm panels to define a back for said seat;

d. A cover panel mounted upon said frame members, said cover carrying indicia for the positioning of foam and fabric thereon and affixing means for mounting said foam thereto.

2. An apparatus as recited in claim 1 in which said affixing means comprises a double backed adhesive tape for mounting and attaching said foam to each of said panels.

3. A preformed kit for upholstered furniture comprising a back panel, two side panels, and a seat panel in which a. each of said panels bears index symbols for locating sheet cushioning material in a predetermined position;

b. each of said panels bears adhesive strips for fastening said sheet material in said predetermined position; and, c. each of said panels bears index symbols capable of locating fabric in a predetermined position; and d. each of said panels bears alignment symbols capable of aligning all panels in an interfitting configuration to form a chair.

4. A furniture kit comprising components for the assembly of an upholstered furniture piece, said kit including:

a. four rectangular frame members;

b. two of said frames defining side arm panels of a chair each having horizontal reinforcing member for affixation of a foam cushion and fabric material thereto, said member also being adapted for fixation of a third panel between said first two panels to define a seat;

c. said fourth frame member being adapted for affixation to said side arm panels to define a back for said seat; and d. a cover panel of lightweight sheet material mounted upon said frame members, said cover panels carrying indicia for the positioning of foam and fabric thereon for mounting said foam thereto.

* * * * *